US005878873A

United States Patent [19]

Clark

[11] Patent Number: 5,878,873

[45] Date of Patent: Mar. 9, 1999

[54] EYEGLASS CONTAINER WITH LID

[75] Inventor: Stewart F. Clark, Salt Lake City, Utah

[73] Assignee: Glassafe, Inc., Salt Lake City, Utah

[21] Appl. No.: 850,560

[22] Filed: May 2, 1997

Related U.S. Application Data

[63] Continuation-in-part of Ser. No. 566,927, Dec. 4, 1995, Pat. No. 5,626,224.

[51] Int. Cl.[6] ..... A45C 11/04

[52] U.S. Cl. ..... 206/6; 220/335; 220/800

[58] Field of Search ..... 206/5, 6; 229/93; 220/334, 335, 342, 343, 799, 800, 802, 805, 793; D3/265, 266; 215/235, 237

[56] References Cited

U.S. PATENT DOCUMENTS

| | | | |
|---|---|---|---|
| 421,438 | 2/1890 | Shailer | 206/5 |
| 636,811 | 11/1899 | Kirstein | 206/5 |
| 768,662 | 8/1904 | Holibaugh | 206/5 |
| 1,834,419 | 12/1931 | Pratt | 206/5 |
| 1,903,798 | 4/1933 | Turner | 229/93 X |
| 2,455,079 | 11/1948 | Mercer . | |
| 2,580,310 | 12/1951 | Magnenat | 220/335 |
| 2,650,700 | 9/1953 | Wolf . | |
| 2,809,766 | 10/1957 | Anderson | 206/6 X |
| 3,559,798 | 2/1971 | Jacobsen . | |
| 3,567,066 | 3/1971 | Mansard | 220/334 X |
| 3,819,033 | 6/1974 | Hueber . | |
| 3,938,655 | 2/1976 | Romolt . | |
| 4,696,401 | 9/1987 | Wallace . | |
| 4,782,941 | 11/1988 | Freise | 206/5 |
| 5,032,019 | 7/1991 | Burchett . | |
| 5,052,550 | 10/1991 | Pfenning . | |
| 5,188,322 | 2/1993 | Kinstrey . | |
| 5,310,048 | 5/1994 | Stechler . | |
| 5,423,419 | 6/1995 | Wentz et al. | 206/6 |
| 5,448,317 | 9/1995 | Huang | 206/6 X |
| 5,513,744 | 5/1996 | Yabarra . | |
| 5,526,924 | 6/1996 | Klutznick | 206/5 |
| 5,590,760 | 1/1997 | Astarb | 206/6 |
| 5,626,224 | 5/1997 | Clark et al. | 206/5 |

FOREIGN PATENT DOCUMENTS

| | | |
|---|---|---|
| 654244 | 12/1937 | Germany . |
| 254506 | 7/1926 | United Kingdom . |

*Primary Examiner*—Bryon P. Gehman
*Attorney, Agent, or Firm*—Workman, Nydegger & Seeley

[57] ABSTRACT

An eyeglass case is provided having a rigid tubular container with an open first end, a closed second end and a lid attached to the rigid tubular container that covers the open first end. The tubular container also comprises an interior surface defining a housing chamber for receiving the eyeglasses. A protective liner is mounted on the interior surface defining the housing chamber, as well as the interior portion of the lid, to provide a soft, protective surface to protect the eyeglasses from scratching while in the eyeglass case. The lid is preferably hingedly attached to the tubular container so that the lid can be easily opened and closed. The lid further comprises a latch that secures the lid over the opening in the closed position.

13 Claims, 3 Drawing Sheets

EYEGLASS CONTAINER WITH LID

This application is a continuation-in-part of U.S. application Ser. No. 08/566,927, now U.S. Pat. No. 5,626,224 issued May 6, 1997 in the names of Stewart F. Clark and K. Wade Karren for EYEGLASS CONTAINER. For purposes of disclosure, the above identified patent.

BACKGROUND OF THE INVENTION

1. The Field of the Invention

The present invention relates to cases for holding eyeglasses and, more specifically, a rigid unitary container having a lid attached thereto for protecting eyeglasses from debris and for securely containing eyeglasses safely in the unitary container.

2. The Relevant Technology

The purchase of eyeglasses, such as sunglasses and prescription glasses, can be an expensive investment often costing several hundred dollars. To obtain long lasting and functional use of a pair of eyeglasses, it is important that the glasses be properly cared for and protected. This is especially important when the glasses are not being used. Many modern eyeglasses are formed from thin, aesthetically appealing frames that can be relatively fragile. Furthermore, proper care of eyeglasses requires that the lenses be protected when not in use so as to avoid scratching of the lenses.

To protect eyeglasses when not in use, numerous different types of eyeglass cases have been developed. The most common type of eyeglass case comprises a soft, flexible pocket having an open end in which the glasses can be selectively inserted and removed. By having the case made of a soft material, the lenses are protected from being scratched. The problem with such a case, however, is that due to its flexible nature, the glasses contained therein can be easily crushed or damaged. This often occurs when the case containing the eyeglasses is dropped or a heavy object is placed on the case. Furthermore, it is easy for the eyeglasses to fall out of the open access to the case.

To remedy these problems, alternative eyeglass cases have been developed. For example, rigid clam shell type eyeglass cases have been designed that prevent the glasses from accidentally being crushed. Such cases often have a soft liner to prevent the lenses from getting scratched. Furthermore, rigid cases typically come with a closure that prevents the eyeglasses from falling out of the case. The closure typically comprises a hinged flap having some form of fastening assembly such a hook or button that keeps the flap closed over the opening of the case.

The problem with conventional rigid clam shell type cases, however, is that they are often bulky and inconvenient to use. For example, clam shell type cases require the use of two hands to open and close, one hand to hold the base and the other hand to open the large bulky lid of the clam shell container. This is especially problematic while performing activities where only one hand is free, such as driving. Another problem with clam shell cases is that the top face can easily open and allow the eyeglasses to fall out, resulting in damages to the eyeglasses. Still further, clam shell eyeglass cases are generally designed to fit only a single style of eyeglass, making it difficult to exchange or store different eyeglasses using the same case.

Other problems generally applicable to all conventional eyeglass cases are that they are designed to lay flat. As such, eyeglass cases are often difficult to see or locate when placed on high shelves. Another problem encountered with most conventional eyeglass cases is that they sink in water. This is often a problem to water skiers, sailors, and boaters who often use glasses around the water.

OBJECTS AND BRIEF SUMMARY OF THE INVENTION

Accordingly, it is therefore an object of the present invention to provide improved eyeglass cases for holding eyeglasses.

It is another object of the present invention to provide improved eyeglass cases that are rigid to prevent crushing of the eyeglasses contained therein.

Still another object of the present invention is to provide improved eyeglass cases as disclosed above wherein the containers are easy to open and close with one hand allowing easy receipt and removal of the eyeglasses therein.

Yet another object of the present invention is to provide improved eyeglass cases comprising tubular unitary containers having lids that securely hold a pair of eyeglasses inside the tubular container keeping debris and other undesirable materials out of the eyeglass case.

Another object of the present invention is to provide improved eyeglass cases wherein a single container can securely hold a variety of different styles of eyeglasses.

Also another object of the present invention is to provide improved eyeglass cases that can be vertically stored on a flat surface.

Finally, another object of the present invention is to provide improved eyeglass cases that float when submersed in water.

In order to achieve the foregoing objects and in accordance with the invention as broadly disclosed and claimed herein, a case for holding eyeglasses is provided. The case comprises a rigid unitary tubular container having a first end and an opposing second end. The container further includes an interior surface defining a holding chamber. The interior surface is defined in part by a first wall, an opposing second wall, and curved side walls. A base member is positioned at the second end of the container so as to close off the second end. The base member is preferably flat to enable the container to vertically stand thereon. Means for covering the open end of the unitary container to contain the eyeglasses received within the holding chamber are attached to the rigid tubular container. The covering means both hold the eyeglasses in the tubular container and prevent sand, dirt and other debris from entering the container and harming the eyeglasses.

The covering means is preferably a lid that is hingedly attached to the tubular container near the open end. The hinge attachment at the first end allows the lid to be easily opened and closed with one hand. Means for securing the lid in the closed position, such as a latch, are provided to ensure the lid does not inadvertently open allowing the glasses to fall from the case.

To further protect the glasses, the interior surface of the tubular container comprises a protective lining to prevent the eyeglasses from being scratched while in the holding chamber of the case.

In a preferred embodiment, eyeglasses are placed within the holding chamber of the container. The glasses are retained in the holding area by the lid in the closed position. The lid is hingedly attached to the tubular container so that it can be easily opened and closed and securely fastened to the tubular container by a latch connecting the lid to the container. The inner portion of the lid and the interior surface of the unitary chamber are lined with a thin soft protective lining so as not to scratch the lenses.

The inventive eyeglass case has several advantages over other cases. For example, eyeglass cases without lids allow debris and other miscellaneous items into the case often damaging the eyeglasses. Because eyeglasses are often kept in purses, undesirable items often enter the container causing damage to the eyeglasses. In addition, to confine the eyeglasses in the holding chamber, the lid attached to the tubular container in the present invention securely excludes undesirable materials from entering the container. The lid hingedly attached to the tubular container is securely fastened by a latch. The latch prevents the lid from inadvertently opening allowing the eyeglasses to fall out of the holding chamber. The latch and the tubular container are such that the container can be held with one hand while the latch is released with the thumb to open the lid. This allows the glasses to be removed from the case with one hand, allowing the other hand to be free for driving. Moreover, because of the tubular design of the container, even if the lid is to inadvertently open, the eyeglasses may not fall out. Still further, another advantage is that the unitary container allows for greater strength and durability when compared to clam shell cases. And finally, the protective liner or the case itself may have a foam material incorporated therewith so that the case will float when containing relatively lightweight glasses.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained will be understood, a more particular description of the invention briefly described above will be rendered by reference to specific embodiments thereof which are illustrated in the appended drawings. Understanding that these drawings depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
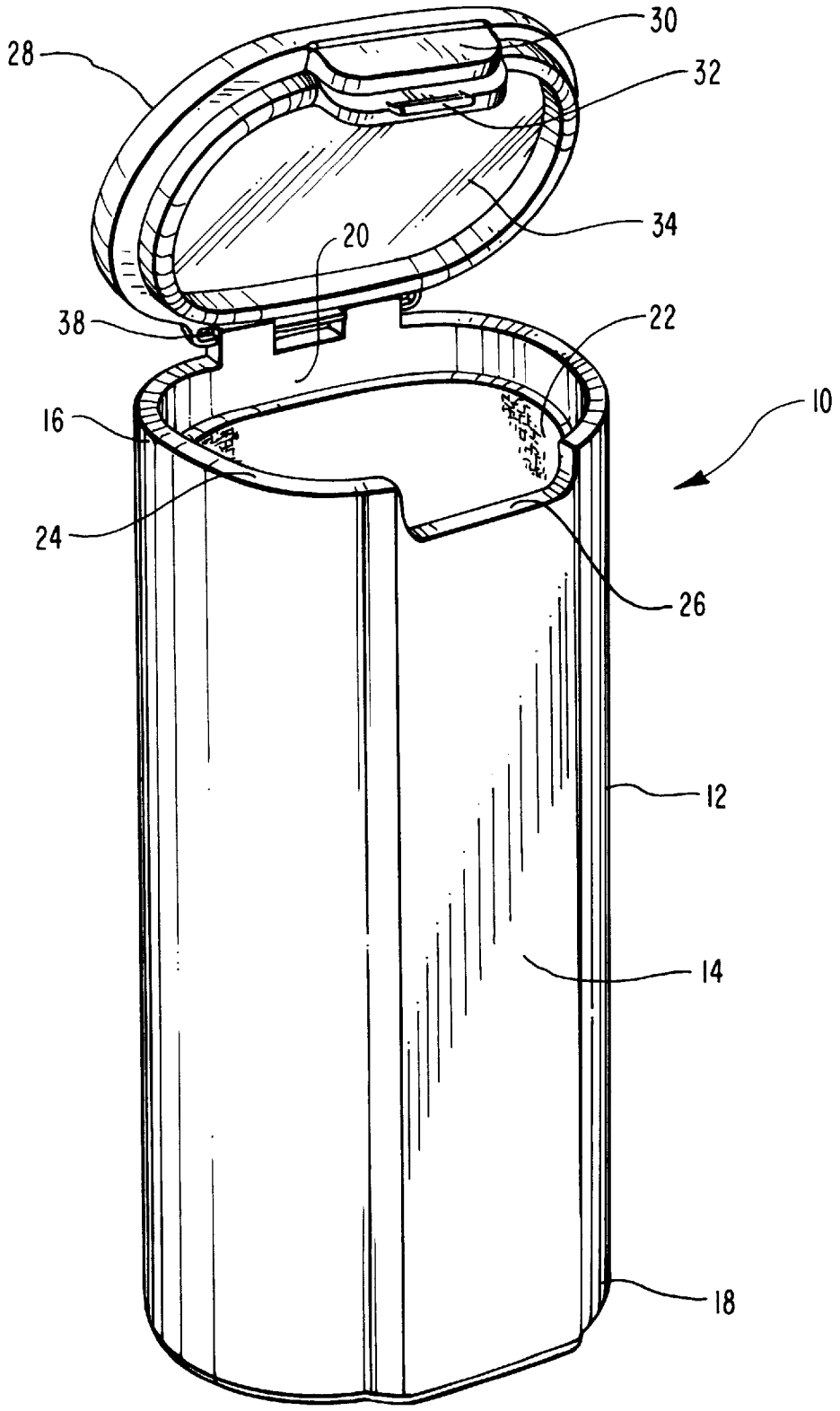
FIG. 1 is a front perspective view of an eyeglass case showing the lid in the open position and the open end of the rigid unitary tubular container.

Depicted in FIG. 1 is one embodiment of an inventive eyeglass case 10 used for holding eyeglasses. The term "eyeglasses" as used in the specification and appended claims is intended to include all styles and kinds of eyeglasses. By way of example and not by limitation, case 10 can be used for holding sunglasses, prescription glasses, and protective glasses. Case 10 is shown in FIG. 1 as comprising a rigid unitary tubular container 12 having an exterior surface 14 extending between a first end 16 and an opposing second end 18. Exterior surface 14 has an outside diameter preferably sized to allow container 12 to fit within a conventional sized cup holder, such as the cup holders incorporated into automobiles.

Container 12 is also shown as having an interior surface 20 that also extends between a first end 16 and a second end 18. Interior surface 20 defines a holding chamber 22 within container 12. Positioned at first end 16 is an annular lip 24 that defines an opening to holding chamber 22. Means for covering the open end so that the eyeglasses are contained in the holding chamber are attached to the unitary tubular container. Lid 28 is an example of a means for covering container 12. The means for covering includes, but is not limited to, a cap, a lid, top or other type covering. The means for covering is preferably prepared from a rigid material and is preferably lined with a protective lining material 34 to protect the eyeglasses from harm. Lid 28 is preferably attached to the tubular container by a means for attaching the lid to the container. Hinge 38 is an example of a means for connecting the lid container 12. Other connecting means can be used to attach the lid to the tubular container, including, but not limited to a string or a tab. In a further embodiment, the means for covering container 12 may not be attached to container 12, but may be a separate piece, such as a cap similar to those used with medicine bottles or to store film for photographs.

Figure 5:
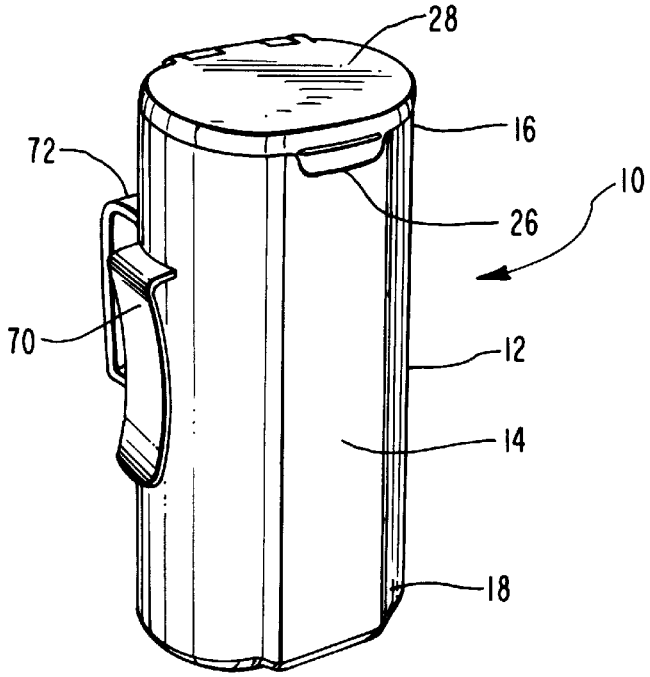
FIG. 5 is a perspective view of an alternative embodiment of an eyeglass container having the lid in the closed position and fastened to the tubular container.

The lid can be in the open position, as illustrated in FIG. 1, wherein the first end 16 of tubular container 12 is open, allowing eyeglasses to be inserted into holding chamber 22 of the eyeglass case. Alternatively, lid 28 can be in the closed position (illustrated in FIG. 5), wherein the lid covers the opening to holding chamber 22 at the first end 16. When lid 28 is in the closed position, the eyeglasses are securely contained in holding chamber 22 of container 12.

When the lid is in the closed position (FIG. 5), the lid is fastened, or held in the closed position by means for securing the covering means. Latch 32 is an example of a means for securing lid 28 to container 12. Other securing means, or differing types of latches can be used, so long as the covering means is securely fastened to the tubular container. Latch 32 teams with ridge 54, illustrated in FIGS. 3 and 4, to securely fasten lid 28 to container 12.

As shown in FIG. 1, container 12 further includes a recessed groove 26 positioned at annular lip 24 and extending a distance toward second end 18. Recessed groove 26 allows latch 32 to be easily engaged and disengaged from ridge 54. For example, a user's thumb can easily press appendage 30 disengaging latch 32 from ridge 54. In fact, because of the location of appendage 30, and the typical size of tubular container 12, the eyeglass case can be held in the palm of the user's hand and the user can open the lid with the thumb of the same hand providing quick, easy access to holding chamber 22 and consequently the user's eyeglasses.

In the preferred embodiment, container 12 is formed as a single unit using conventional injection molding processes. Alternatively, other molding process, such as die casting or blow molding, can also be used. Furthermore, container 12 can be formed in separate parts which are later assembled together. Container 12 along with lid 28 are preferably formed of polypropylene. There are, of course, a variety of different materials that can also be used. By way of example and not by limitation, container 12 can be formed from metals, composites, fiberglass, wood, or other plastics such as polystyrene.

Figure 2:
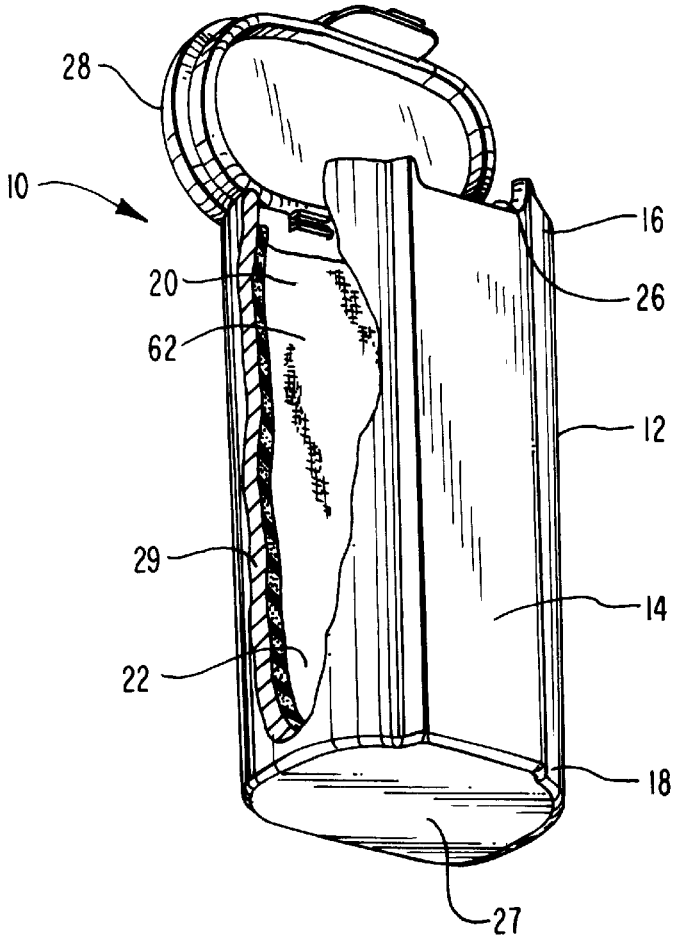
FIG. 2 is a partially exploded view of an eyeglass case with the tubular container being partially cut away to disclose the protective liner within the container.

Positioned at second end 18, as depicted in FIG. 2, is a base member 27 that closes off access to holding chamber 22. Base member 27 is substantially flat and configured so as to enable container 12 to vertically stand on base member 27. Container 12 can also be formed having a wall with a thickness that increases from first end 16 to second end 18. By having the thickness minimized at top end 16, container 12 has increased flexibility at top end 16 for increased ease in insertion and removal of the glasses.

In one embodiment of the present invention, the eyeglass case is able to float in water. This is particularly the case when protective liner comprises a thick foam material and lightweight eyeglasses are carried by the eyeglass case or the case itself.

Figure 3:
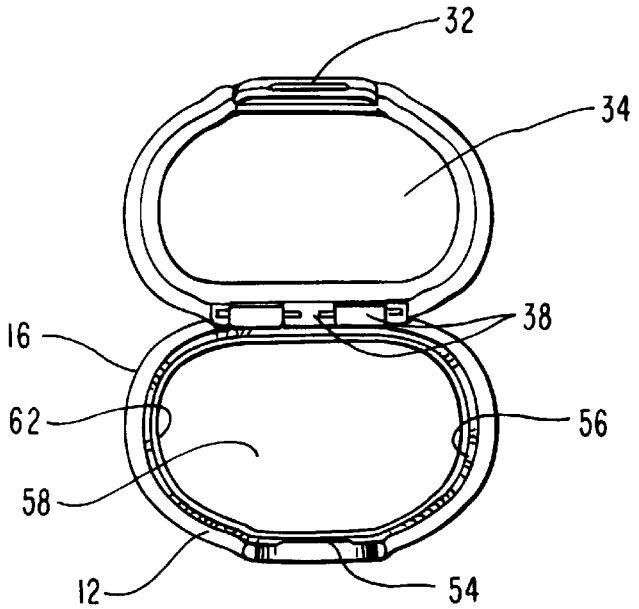
FIG. 3 is an end view of an eyeglass container having the lid in the open position, and illustrating the protective liner disposed around the interior surface of the container and the interior of the lid.
Figure 4:
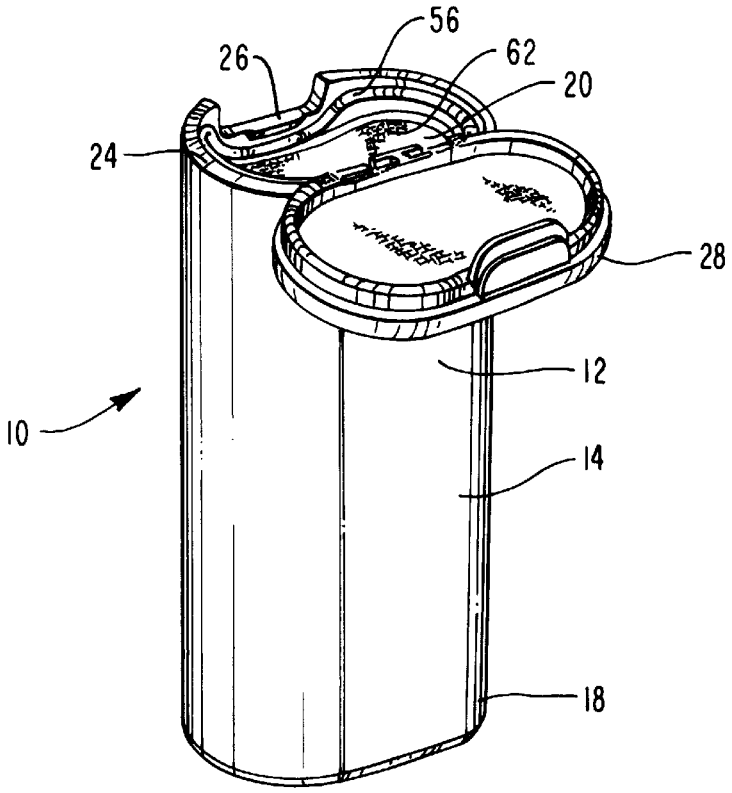
FIG. 4 is a back perspective view of an eyeglass container having the lid in the open position and showing a lining positioned on the interior surface of the container and the lid.

In a related embodiment, illustrated in FIGS. 3 and 4, an O-ring 56 can be placed around the interior portion of annular lip 24, in holding chamber 22 to form a seal with lid 34. Alternatively, the O-ring can be placed around the periphery of the inner portion of the lid so that a water-tight seal is formed when the lid is in the closed position. The seal formed by the O-ring and the inner portion of lid 34 functions to keep water or other liquids out of the holding chamber 22 causing the eyeglass case to be waterproof. In addition, the lid and the seal formed by the O-ring 56 function to keep any harmful debris, liquid or gas from entering the holding chamber and damaging the eyeglasses. The water-tight seal formed by the O-ring is especially useful when eyeglass case is used to store eyeglasses around water, such as during boating, water skiing, at the beach and at the pool.

In a preferred embodiment, as illustrated in FIGS. 3 and 4, the interior surface defining a holding chamber is lined with a protective liner 62. Protective liner 62 can be any material that protects the eyeglasses from being scratched or otherwise damaged while in the holding chamber. For instance, the protective liner is preferably a soft, resilient material that is scratch resistant. Suitable materials for protective linings include, but are not limited to felt, foam, silk, nylon, rayon, satin or the like. In addition, depending on its thickness, the protective lining functions to absorb impact to the case or other movement of the eyeglasses in the case. This is important in cases where an eyeglass case is dropped or otherwise abruptly impacted. Likewise, in a preferred embodiment, the inner portion of lid 28 comprises a protective liner so that the entire surface of holding chamber 22 is lined with a protective liner.

It is noted, however, that all dimensions and sizes disclosed herein are only by way of example and not intended to be limiting. In alternative embodiments, the sizes and dimensions can be proportionally altered to accommodate uniquely configured eyeglasses.

Depicted in FIG. 3 is a top view of container 12 looking into eyeglass case 10 having a protective liner therein. Interior surface 20 of container 12 is shown in FIG. 3 as being substantially oval shaped and defined by a substantially flat first wall, opposing substantially flat second wall, and curved sidewalls.

In yet another embodiment, the protective liner on the interior surface of the holding chamber is removable. Securing protective liner 62 within the holding chamber can be accomplished by any known means, such as by using any suitable adhesive or other attaching means, such as VELCRO™. By changing the protective liner in the holding chamber, the eyeglass case can be tailored for specific eyeglasses. For instance, the protective liner can be made thicker to accommodate smaller eyeglasses, thus reducing the amount the eyeglasses move within the holding chamber and decreasing the impact on the eyeglasses. Likewise, other users may desire thin protective liners allowing for easy insertion and removal of the eyeglasses.

During use, folded eyeglasses are slid into holding chamber 22 through the opening 72 (FIG. 3) at first end 16. In light ofthe fact that the protective liner can be a variety of different sizes and shapes, many different size and shapes of glasses can be received in the holding chamber. Also, in alternative embodiments, different sizes of container 12 can be formed to hold different sizes of glasses.

Furthermore, in another embodiment, the second end 18 can be open to allow access to holding chamber 22 from both the first end 16 and the second end 18. In this embodiment, the case preferably comprises a second means for covering the open second end. As with the means for covering the first open end, a lid 28 is an example of a means for covering the second open end.

In one embodiment, as shown in FIG. 4, interior surface 20 can be lined with a soft cushioning material 29 such as foam or other type of padding, to further protect the frame and other structures of the glasses. Likewise, the interior surface of lid 28 also preferably comprises a cushioning material to further protect the eyeglasses.

In another alternative embodiment of eyeglass case 10, a cleaning cloth can be positioned within holding chamber 22 to allow selective cleaning of the lenses of the glasses. The cleaning cloth can be made out of a chamois or other soft material commonly known to those in the art. A holding bag can also initially be used for receiving the glasses prior to positioning the glasses within holding chamber 22. The holding bag preferably has a draw string or other means for closing the bag so as to prevent dirt, sand, or other debris from coming in contact with the glasses.

The present invention also provides means for attaching container 12 to an independent object. By way of example and not by limitation, FIG. 5 discloses exterior surface 14 of container 12 having a mounting clip 70 secured thereto. Alternatively, a loop 72 is also shown attached to exterior surface 14 so as to enable attachment of the container 12 to a belt or other kind of strap.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A case for holding eyeglasses comprising:

(a) a substantially rigid unitary tubular container having an interior surface extending from a first end to an opposing closed second end, the interior surface bounding a holding chamber, an annular lip being formed at the first end of the container and defining an opening to the holding chamber;

(b) a lid being hingedly attached to the first end of the container, the lid being selectively moved between an open position wherein the opening to the holding chamber is freely exposed and a closed position wherein the lid is disposed over the opening to the holding chamber;

(c) a recessed groove formed on the annular lip and extending towards the second end of the container; and (d) the lid comprising a substantially flat body portion having an appendage orthogoally projecting therefrom, the appendage being received within the recessed groove when the lid is in the closed position.

2. A case as recited in claim 1, wherein the interior surface has a ridge formed thereon and the appendage has an outside face with a latch formed thereon, the latch engaging the ridge when the lid is in the closed position.

3. A case as recited in claim 1, wherein the lid has a top surface that is substantially flat, the top surface of the lid being disposed in a plane orthogonal to the longitudinal axis of the container when the lid is in the closed position.

4. A case as recited in claim 1, wherein the container is comprised of polypropylene.

5. A case as recited in claim 1, further comprising a protective liner disposed on the interior surface of the container.

6. A case as recited in claim 1, further comprising a clip mounted to the container.

7. A case for holding eyeglasses comprising;

(a) a substantially rigid unitary tubular container having an interior surface extending from a first end to an opposing closed second end, the interior surface bounding a holding chamber, an annular lip being formed at the first end of the container and defining an opening to the holding chamber, the annular lip having a recessed groove extending towards the second end of the container;

(b) a lid being hingedly attached to the first end of the container, the lid comprising a substantially flat body portion having an appendage orthogonally projecting therefrom, the lid being selectively moved between an open position wherein the opening to the holding chamber is freely exposed and a closed position wherein the lid is disposed over the opening to the holding chamber and the appendage is received within the recessed groove; and (c) means for mechanically and releasable securing the appendage to the container when the appendage is disposed within the recessed groove.

8. A case as recited in claim 7, wherein the interior surface has a ridge formed thereon and the appendage has an outside face with a latch formed thereon, the latch engaging the ridge when the lid is in the closed position.

9. A case as recited in claim 7, wherein the lid has a top surface that is substantially flat, the top surface of the lid being disposed in a plane orthogonal to the longitudinal axis of the container when the lid is in the closed position.

10. A case as recited in claim 7, wherein the container is comprised of metal.

11. A case as recited in claim 7, further comprising a protective liner disposed on the interior surface of the container.

12. A case as recited in claim 7, further comprising a clip mounted to the container.

13. A case as recited in claim 7, further comprising an O-ring forming a seal between the lid and the container when the lid is in the closed position.

* * * * *